US009738414B2

(12) United States Patent
Takeuchi

(10) Patent No.: US 9,738,414 B2
(45) Date of Patent: Aug. 22, 2017

(54) PAPER PALLET HAVING A PLURALITY OF LEG BEAMS, AND PACKAGING CASE INCLUDING PAPER PALLET

(71) Applicant: KYOCERA Document Solutions Inc., Osaka-shi, Osaka (JP)

(72) Inventor: Masakazu Takeuchi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 34 days.

(21) Appl. No.: 15/182,508

(22) Filed: Jun. 14, 2016

(65) Prior Publication Data

US 2016/0362222 A1 Dec. 15, 2016

(30) Foreign Application Priority Data

Jun. 15, 2015 (JP) ..... 2015-120579

(51) Int. Cl.
*B65D 19/00* (2006.01)

(52) U.S. Cl.
CPC ..... *B65D 19/0095* (2013.01); *B65D 2519/00019* (2013.01); *B65D 2519/00054* (2013.01); *B65D 2519/00089* (2013.01); *B65D 2519/00124* (2013.01); *B65D 2519/00273* (2013.01); *B65D 2519/00293* (2013.01); *B65D 2519/00303* (2013.01); *B65D 2519/00323* (2013.01); *B65D 2519/00333* (2013.01); *B65D 2519/00378* (2013.01)

(58) Field of Classification Search
CPC ..... B65D 2519/00019; B65D 2519/00054; B65D 2519/00089; B65D 2519/00124; B65D 2519/00273; B65D 2519/00303; B65D 2519/00318; B65D 2519/00358; B65D 2519/00373; B65D 2519/00388; B65D 2519/00432; B65D 71/0096
USPC ..... 108/51.11, 51.3, 56.1, 56.3, 57.33; 206/386, 509, 564, 585, 600; 217/43 A; 220/6; D34/38
See application file for complete search history.

(56) References Cited

U.S. PATENT DOCUMENTS 3,626,860 A * 12/1971 Blatt ..... B65D 19/0026 108/51.3
4,863,024 A * 9/1989 Booth ..... B65D 19/0016 108/51.3

(Continued)

FOREIGN PATENT DOCUMENTS

JP 06239347 A 8/1994
JP 07052948 A 2/1995

*Primary Examiner* — Chun Cheung
*Assistant Examiner* — Brijesh V. Patel
(74) *Attorney, Agent, or Firm* — Alleman Hall Creasman & Tuttle LLP

(57) ABSTRACT

A paper pallet according to an aspect of the present disclosure includes a plurality of leg beams each formed such that a cross section thereof has a rectangular shape, each leg beam being long in one direction. At least one of the plurality of leg beams includes: a laminated structure in which a plurality of sheet-like paper core materials are laminated in a width direction of the leg beam orthogonal to a longitudinal direction of the leg beam and which has a cavity formed therein; and a honeycomb structure fitted into the cavity of the laminated structure and having a plurality of tubular cells extending in the width direction.

7 Claims, 4 Drawing Sheets

(56) References Cited

U.S. PATENT DOCUMENTS

| | | | | | |
|---|---|---|---|---|---|
| 5,230,291 | A * | 7/1993 | Juvik-Woods | B65D 19/0012 | 108/51.3 |
| 5,269,219 | A * | 12/1993 | Juvik-Woods | B65D 19/0016 | 108/51.3 |
| 5,493,962 | A * | 2/1996 | McCarthy | B65D 19/0026 | 108/51.3 |
| 5,537,937 | A * | 7/1996 | Juvik-Woods | B65D 19/0012 | 108/51.3 |
| 5,595,125 | A * | 1/1997 | Bridges, Jr. | B65D 19/0012 | 108/51.3 |
| 6,357,364 | B1 * | 3/2002 | Maloney | B65D 19/0026 | 108/51.11 |
| 6,470,649 | B2 * | 10/2002 | Usui | B65D 19/0069 | 206/386 |
| 2002/0189507 | A1 * | 12/2002 | Benner | B65D 19/0012 | 108/51.3 |
| 2006/0207481 | A1 * | 9/2006 | McCarthy | B65D 19/0026 | 108/51.3 |
| 2008/0196633 | A1 * | 8/2008 | Ho | B65D 19/0075 | 108/51.3 |
| 2009/0288976 | A1 * | 11/2009 | Shiraki | B65D 21/0224 | 206/386 |
| 2011/0132238 | A1 * | 6/2011 | Jaegers | B65D 19/0026 | 108/55.1 |

* cited by examiner

PAPER PALLET HAVING A PLURALITY OF LEG BEAMS, AND PACKAGING CASE INCLUDING PAPER PALLET

INCORPORATION BY REFERENCE

This application is based upon and claims the benefit of priority from the corresponding Japanese Patent Application No. 2015-120579 filed on Jun. 15, 2015, the entire contents of which are incorporated herein by reference.

BACKGROUND

The present disclosure relates to a pallet capable of supporting an article such as an image forming apparatus, and a packaging case for packaging an article.

A pallet is used when an article such as an image forming apparatus or an information processing apparatus is conveyed. In a state where the article is placed on the pallet, the article is conveyed together with the pallet by a conveying machine such as a forklift. As the pallet, a paper pallet composed of a corrugated cardboard sheet is known. The paper pallet is widely used in recent years, since the paper pallet is lightweight, the transportation cost thereof is low, and the paper pallet is easily recycled and disposed of.

In general, the material of the paper pallet is paper such as a corrugated cardboard sheet, and thus the paper pallet has lower strength and stiffness than a resin pallet and a wood pallet. Meanwhile, a paper pallet using a honeycomb structure for enhancing strength in the vertical direction is known.

SUMMARY

A paper pallet according to an aspect of the present disclosure includes a plurality of long leg beams each formed such that a cross section thereof has a rectangular shape. At least one of the plurality of leg beams includes: a laminated structure in which a plurality of sheet-like paper core materials are laminated in a width direction of the leg beam orthogonal to a longitudinal direction of the leg beam; and a honeycomb structure fitted into a cavity formed within the laminated structure, the honeycomb structure having a plurality of tubular cells extending in the width direction.

A packaging case according to another aspect of the present disclosure includes the paper pallet, a tray, and an outer case. The tray is for supporting an article and is joined to an upper surface of the paper pallet. The outer case includes a side plate forming an outer peripheral surface and is opened at a lower surface thereof, and the side plate has a lower portion fitted to the tray. The packaging case is configured to be able to package the article in an internal space surrounded by the tray and the outer case.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the drawings as appropriate. The embodiment described below is merely an example embodying the present disclosure, and does not limit the technical scope of the present disclosure. It should be noted that for convenience of explanation, in an installation state where a paper pallet 10 according to the present embodiment and a packaging case 11 including the paper pallet 10 are installed on a flat surface (a state shown in FIG. 1), an up-down direction, a front-rear direction, and a right-left direction are defined as shown in FIG. 1.

[Packaging Case 11]

First, the configuration of the packaging case 11 according to the embodiment of the present disclosure will be described with reference to FIG. 1. The packaging case 11 is for packaging an article 100 (see FIG. 2A). The packaging case 11 is used for protecting the article 100 when the article 100 is conveyed, transported, or stored. An example of the article 100 that is packaged by the packaging case 11 is an image forming apparatus such as a copying machine, a multifunction peripheral, or a printer, and is particularly a self-standing image forming apparatus that is large-sized and heavy. The packaging case 11 is suitably used for such an image forming apparatus. As a matter of course, the article 100 is not limited to such an image forming apparatus, and examples thereof include various products that have to be protected by the packaging case 11 from factors such as shocks received during conveyance and environmental changes (temperature change, humidity change, etc.) during storage.

Figure 1:
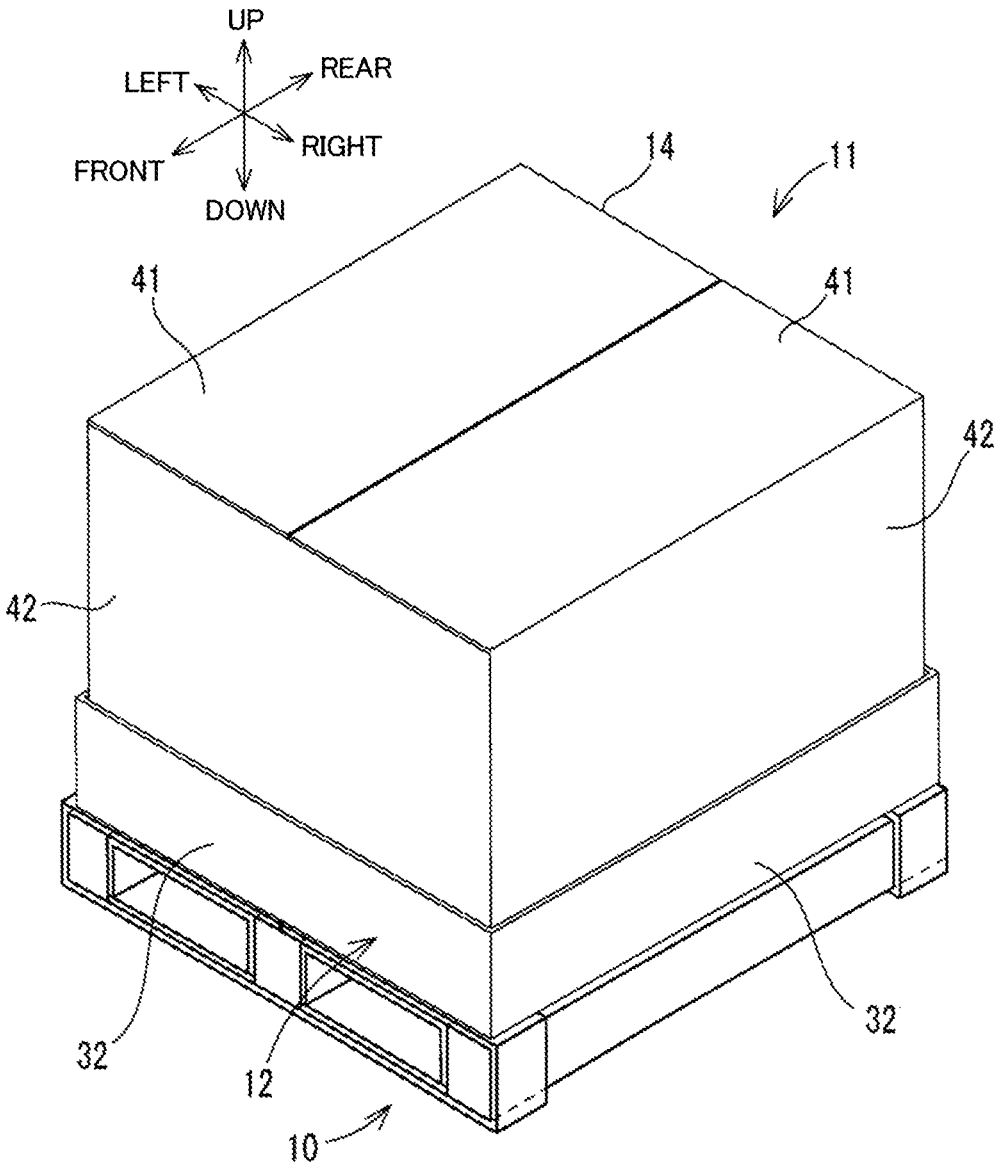
FIG. 1 is a perspective view of a packaging case according to an embodiment of the present disclosure.
Figure 2A:
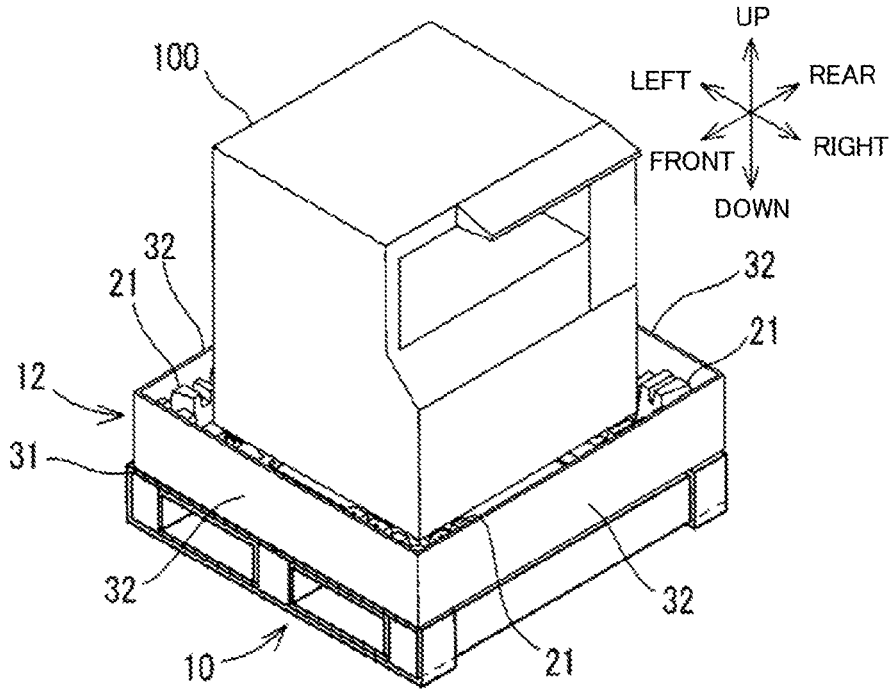
FIG. 2A is a diagram showing a state where an image forming apparatus is housed in the packaging case shown in FIG. 1.
Figure 2B:
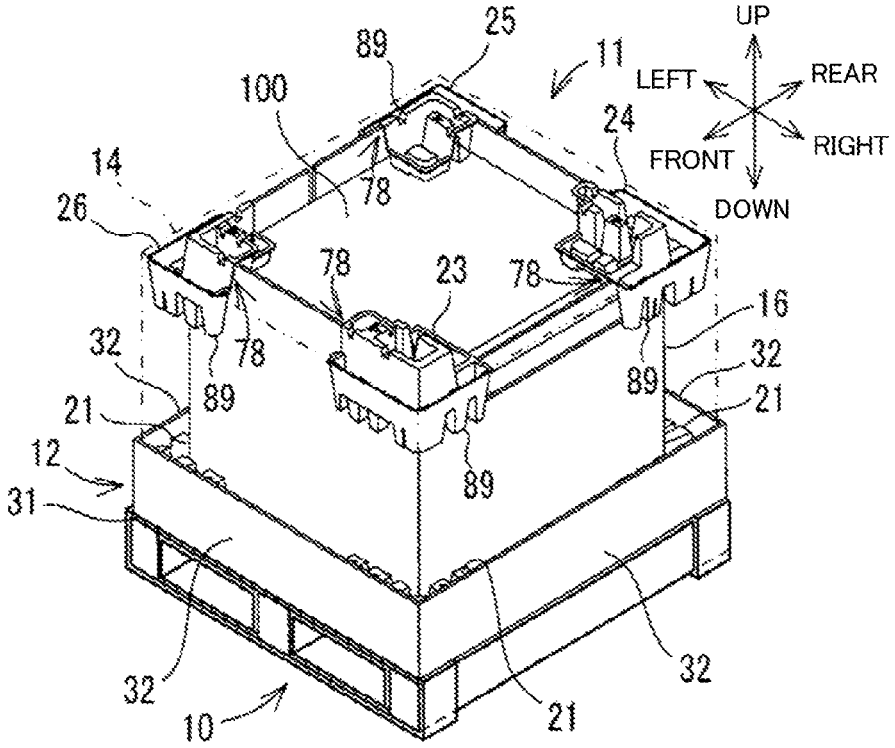
FIG. 2B is a diagram showing the state where the image forming apparatus is housed in the packaging case shown in FIG. 1.

As shown in FIGS. 1 and 2B, the packaging case 11 includes a tray 12, an outer case 14, an inner frame 16 (see FIG. 2B), a support member 21 (see FIG. 2B), support members 23 to 26 (see FIG. 2B), and the paper pallet 10.

[Tray 12]

As shown in FIGS. 2A and 2B, the tray 12 is opened at an upper surface thereof and supports a bottom portion of the article 100. The tray 12 is formed in a rectangular shape. The tray 12 is fixed to the upper surface of the paper pallet 10 that is located at a lowermost portion of the packaging case 11. The tray 12 is joined to the upper surface of the paper pallet 10 by means of an adhesive or the like such that the tray 12 is not easily separated from the upper surface of the paper pallet 10.

The tray 12 supports the bottom portion of the article 100 by a bottom plate 31 that forms the bottom surface of the tray 12. In the present embodiment, the tray 12 supports the bottom portion of the article 100 via the support member 21 provided on the bottom plate 31. The tray 12 includes the rectangular-shaped bottom plate 31 and four side plates 32 provided in a standing manner at the four edges, respectively, of the bottom plate 31. The respective four side plates 32 form four side surfaces of the tray 12. The tray 12 is composed of, for example, a corrugated cardboard sheet.

The support member 21 is composed of, for example, a molded pulp product (cushioning member) obtained by molding a pulp material obtained by recycling waste paper or the like. As a matter of course, the support member 21 is not limited to the molded pulp product, and may be composed of a cushioning member made of foamed resin, etc. The support member 21 is laid on the bottom plate 31 of the tray 12, and the bottom portion of the article 100 is placed on an upper portion of the support member 21 as shown in FIG. 2A.

[Outer Case 14]

As shown in FIG. 1, the outer case 14 is formed in a parallelepiped shape, and is opened at a lower surface thereof. The outer case 14 includes four side plates 42 that form four side surfaces that are the outer peripheral surface of the outer case 14. A flap 41 is connected to the upper edge of each side plate 42. The upper surface of the outer case 14 is sealed by bending these four flaps 41 inward, and further connecting the respective flaps 41 to each other by means of a fastener such as adhesive tape. A lower portion of the outer case 14 is fitted to the tray 12. Specifically, the lower portion of the outer case 14 is inserted into the inner side of each side plate 32 of the tray 12, and portions of the tray 12 and the outer case 14 that overlap each other are fastened to each other by means of fasteners (not shown) such as joint metal fittings. By the tray 12 and the outer case 14 being fastened in this manner, an internal space is formed between the tray 12 and the outer case 14, so that the article 100 can be packaged in this internal space. Through holes (not shown) for fastening are formed in each side plate 32 of the tray 12 and the outer case 14 so as to overlap each other when the outer case 14 is inserted into the tray 12. The fasteners are fitted into the through holes. Accordingly, the outer case 14 is fixed to the tray 12. The outer case 14 is composed of, for example, a corrugated cardboard sheet.

[Inner Frame 16]

As shown in FIG. 2B, the inner frame 16 is formed such that a cross section thereof has a rectangular tube shape, and is opened at both an upper surface and a lower surface thereof. The inner frame 16 is provided between the outer case 14 and the article 100 supported by the tray 12. The inner frame 16 is mounted on the article 100 so as to cover the outer peripheral surface of the article 100. The lower end of the inner frame 16 is supported by the support member 21 of the tray 12 in a state where the outer periphery of the article 100 is covered with the inner frame 16. The inner frame 16 is composed of, for example a corrugated cardboard sheet.

[Support Members 23 to 26]

As shown in FIG. 2B, the support members 23 to 26 are mounted on corner portions of the upper edge of the inner frame 16. Cuts that are not shown are formed at the upper edge of the inner frame 16. When the support members 23 to 26 are mounted on the inner frame 16, the cuts position the support members 23 to 26 such that the support members 23 to 26 are not displaced. Grooves 78 each forming a right angle and into which the corner portions of the upper edge of the inner frame 16 are inserted are formed in the support members 23 to 26. The upper edges of the corner portions of the inner frame 16 are inserted into the grooves 78. Accordingly, the support members 23 to 26 are mounted on the corner portions of the inner frame 16.

Cushioning portions 89 are provided in the support members 23 to 26 and at the outer sides of the grooves 78. The cushioning portions 89 are located between the side plates 42 of the outer case 14 and the inner frame 16 when the support members 23 to 26 are mounted on the upper edge of the inner frame 16.

[Paper Pallet 10]

Figure 3:
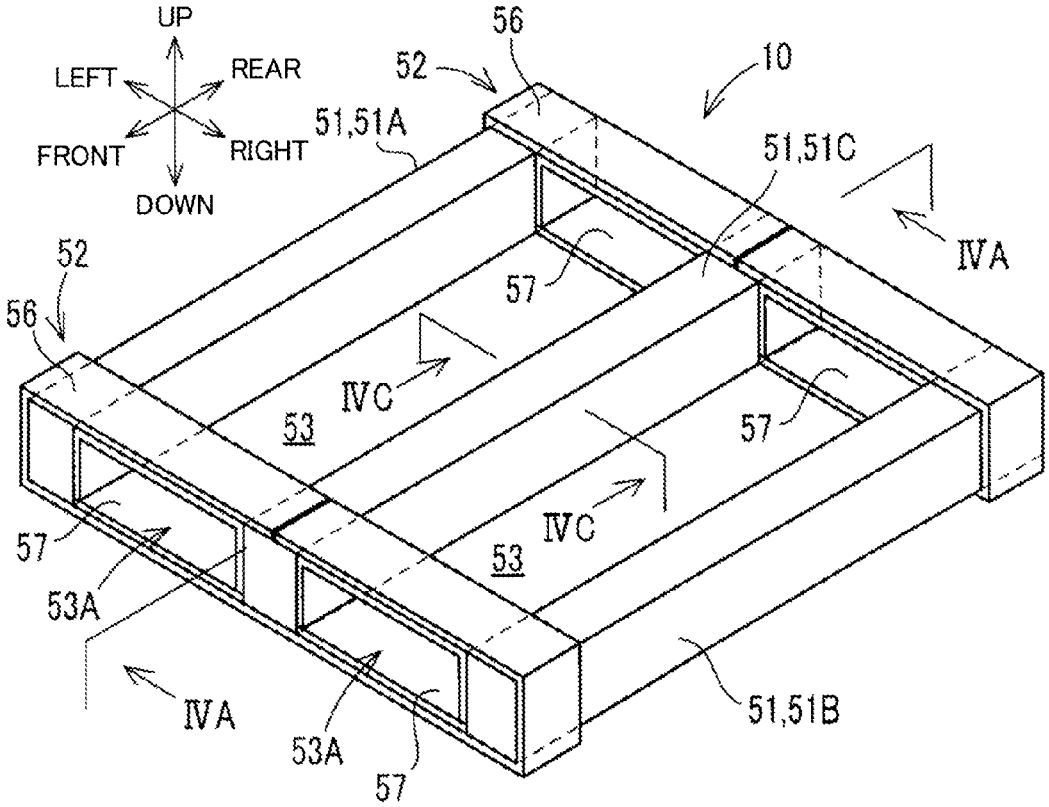
FIG. 3 is a perspective view showing the configuration of a paper pallet according to the embodiment of the present disclosure.

Hereinafter, the configuration of the paper pallet 10 will be described with reference to FIG. 3.

The paper pallet 10 supports the article 100 together with the tray 12 and the like at the upper side thereof. When a cargo such as the article 100 is conveyed, the article 100 is conveyed together with the paper pallet 10 by a conveying machine such as a forklift in a state where the article 100 is placed on the upper surface of the paper pallet 10. As shown in FIG. 3, the paper pallet 10 includes three leg beams 51 (51A to 51C) and connection members 52 that connect the respective leg beams 51.

Of the three leg beams 51, the two leg beams 51A and 51B are disposed at both edges, in the right-left direction, of the paper pallet 10. In addition, the leg beam 51C is disposed at a mid-position between the leg beam 51A and the leg beam 51B. Each leg beam 51 is formed such that a cross section thereof has a rectangular shape, and is a long member extending in the front-rear direction. In the present embodiment, the paper pallet 10 including the three leg beams 51 is shown, but the paper pallet 10 suffices to have at least the two leg beams 51A and 51B.

The connection members 52 are provided at front end portions and rear end portions of the respective leg beams 51. The connection members 52 connect the respective leg beams 51 such that the leg beams 51 are spaced apart from each other in the right-left direction at equal intervals. By the respective leg beams 51 being connected by the connection members 52, two insertion spaces 53 into which a fork of the conveying machine such as a forklift can be inserted are formed between the respective leg beams 51. The openings of the insertion spaces 53 at the front end side or the rear end side are insertion ports 53A through which the fork of the conveying machine is inserted, and the fork of the conveying machine is inserted toward the insertion ports 53A.

The connection members 52 may be provided not only at both end portions, in the front-rear direction, of each leg beam 51 but also at a center portion, in the front-rear direction, of each leg beam 51. As a matter of course, a plurality of connection members 52 may be provided on the respective leg beams 51 so as to be aligned continuously in the front-rear direction Each connection member 52 includes an outer paper board 56 wound on the three leg beams 51 in the right-left direction. The outer paper board 56 is formed so as to be relatively thick and tough. The outer paper board 56 is, for example, a laminated paper composed mainly of kraft paper or waste paper. In a state where the outer paper board 56 is wound on the three leg beams 51, the respective end portions thereof in the longitudinal direction are butted against each other on the upper surface of the leg beam 51C at the center. An adhesive or the like is applied to a contact portion of the outer paper board 56 that is brought into contact with each leg beam 51 when the outer paper board 56 is wound on the three leg beams 51, so that the outer paper board 56 and the contact surface of each leg beam 51 are firmly fixed to each other.

In addition, each connection member 52 includes annular inner paper boards 57 provided between the adjacent leg beams 51. Similarly to the outer paper board 56, each inner paper board 57 is formed so as to be relatively thick and tough, and is composed of a laminated paper composed mainly of kraft paper or waste paper. Each inner paper board 57 is firmly joined by means of an adhesive or the like to the inner surface of the outer paper board 56 facing the insertion space 53 and the inner surface of each leg beam 51 facing the insertion space 53. Each inner paper board 57 may be formed by bending one paper board into an annular shape, or may be formed by connecting one paper board to one paper board that has been bent at two portions in the longitudinal direction thereof, to form an annular shape.

Incidentally, a honeycomb structure of a conventional paper pallet has a cavity extending in the vertical direction. Thus, the conventional paper pallet has enhanced strength in the vertical direction but has low strength in a lateral direction. Therefore, there is a problem that when an external force is applied to a leg beam of the conventional paper pallet in the lateral direction, the leg beam is bent, recessed, or buckled (hereinafter, referred to as buckled or the like). On the other hand, each leg beam 51 of the paper pallet 10 according to the present embodiment is composed of a laminated structure 61 and a honeycomb structure 62 as described later. Thus, in the paper pallet 10, the weight can be reduced while high strength in each of the vertical direction and the horizontal direction is achieved.

[Configurations of Leg Beams 51]

Hereinafter, the configuration of each leg beam 51 will be described with reference to FIGS. 4A to 4C.

Figure 4A:
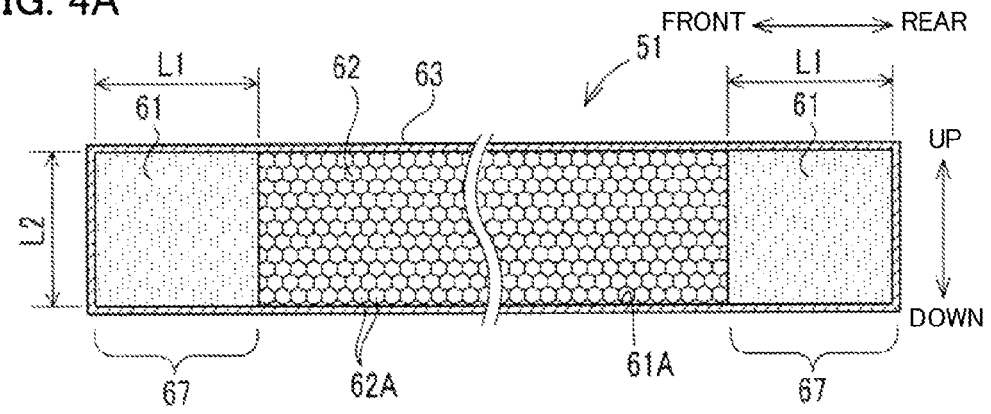
FIG. 4A is a diagram showing the configuration of the paper pallet in FIG. 3 and is a cross-sectional view in a longitudinal direction when a leg beam of the paper pallet is cut at the center in a width direction thereof.
Figure 4B:
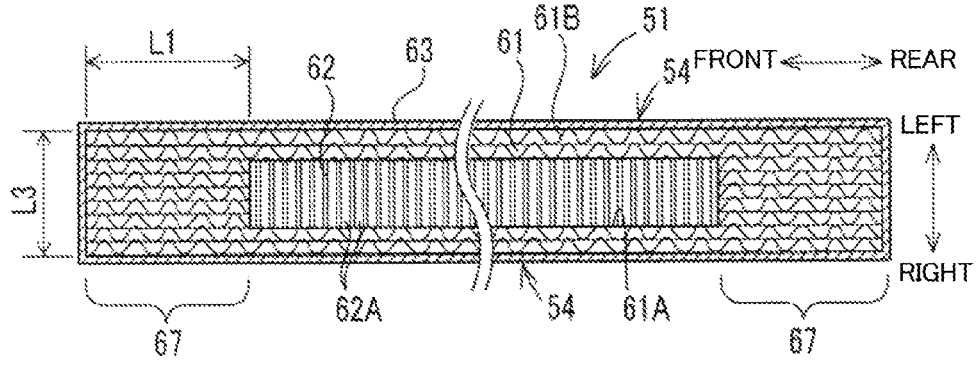
FIG. 4B is a cross-sectional view in a horizontal direction when the leg beam of the paper pallet is cut at the center in an up-down direction.
Figure 4C:
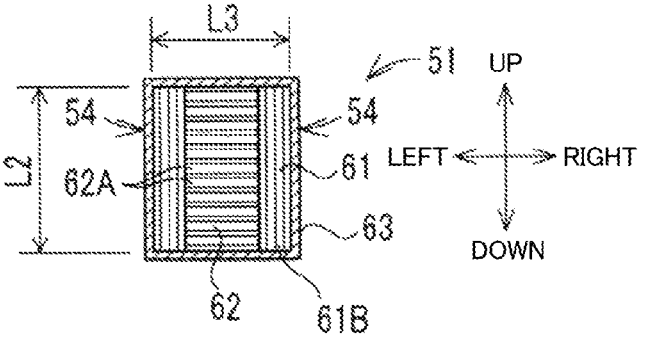
FIG. 4C is a cross-sectional view in the width direction when the leg beam of the paper pallet is cut at the center in the longitudinal direction of the leg beam.

As shown in FIGS. 4A to 4C, the leg beam 51 is composed of the laminated structure 61 and the honeycomb structure 62. In the laminated structure 61, a plurality of sheet-like paper core materials 61B are laminated in the right-left direction (the width direction of the leg beam 51). In other words, when the paper pallet 10 is in the installation state shown in FIG. 1, the plurality of core materials 61B are laminated in the horizontal direction. Specifically, each core material 61B is a corrugated cardboard sheet, and the laminated structure 61 is structured such that a plurality of corrugated cardboard sheets are joined to each other by means of an adhesive.

The conventional leg beam has a configuration in which a water-repellent exterior sheet 63 such as kraft paper is wound on the laminated structure 61. That is, the conventional leg beam is composed mainly of the laminated structure 61. However, since the conventional leg beam has a configuration in which corrugated cardboard sheets are laminated, the conventional leg beam has high strength in directions (the up-down direction and the front-rear direction) orthogonal to the lamination direction, but has low strength in the lamination direction (right-left direction). Thus, for example, when a fork inserted through insertion ports 53A is pressed against the inner surface of the leg beam, the leg beam may be buckled or the like. In order to solve such a problem, in the leg beam 51 according to the present embodiment, the honeycomb structure 62 is provided in addition to the laminated structure 61.

Specifically, as shown in FIGS. 4A and 4B, a cavity 61A is formed in a center portion of the laminated structure 61. The cavity 61A penetrates the laminated structure 61 in the up-down direction. The honeycomb structure 62 is provided in the cavity 61A. In the present embodiment, the cavity 61A is filled with the honeycomb structure 62 without any gap. The laminated structure 61 is provided with a predetermined thickness between the cavity 61A and a side surface 54 (see FIG. 4B) of the leg beam 51.

The honeycomb structure 62 has a large number of tubular cells 62A extending in one direction. The shape of each tubular cell 62A is a regular hexagonal column having a regular hexagonal cross-sectional shape, and the honeycomb structure 62 is structured such that the tubular cells 62A are arranged without any gap. The inner diameter of each tubular cell 62A of the honeycomb structure 62 is set so as to be larger than the dimension of each cavity within the one core material 61B (corrugated cardboard sheet). Thus, the weight, per unit volume, of the honeycomb structure 62 according to the present embodiment is lighter than the weight, per unit volume, of the laminated structure 61. In the present embodiment, as shown in FIG. 4B, the honeycomb structure 62 is provided in the cavity 61A such that the direction in which the tubular cells 62A extend coincides with the right-left direction of the leg beam 51. In other words, when the paper pallet 10 is in the installation state shown in FIG. 1, the tubular cells 62A of the honeycomb structure 62 extend in the horizontal direction. An adhesive or the like is applied to a contact portion between the inner surface of the cavity 61A and the honeycomb structure 62, whereby the honeycomb structure 62 and the laminated structure 61 are firmly joined to each other. The shape of each tubular cell 62A is not limited to the regular hexagonal column, and a large number of tubular cells 62A each having a shape other than the regular hexagonal column may be arranged without any gap.

As shown in FIGS. 4B and 4C, the leg beam 51 is formed such that a height size L2 thereof is longer than a width size L3 thereof. In addition, in the leg beam 51, each of end portions 67 extending from both ends, in the front-rear direction (longitudinal direction), of the leg beam 51 to both ends, in this direction, of the cavity 61A is formed such that a size L1 in the front-rear direction (longitudinal direction) thereof is longer than the width size L3. The sizes L1, L2, and L3 are sizes excluding the thickness of the exterior sheet 63.

Advantageous Effects of Embodiment

Since the paper pallet 10 is configured as described above, the strength, in the up-down direction, of each leg beam 51 is ensured by the laminated structure 61, and the strength, in the right-left direction, of the each leg beam 51 is ensured by the honeycomb structure 62. Thus, owing to the laminated structure 61, each leg beam 51 is not crushed when a heavy load is placed on the paper pallet 10; and, owing to the honeycomb structure 62, each leg beam 51 is prevented from being buckled or the like when the inner surface of the leg beam 51 is pressed by the fork inserted through the insertion ports 53A.

Each end portion 67, in the front-rear direction, of the leg beam 51 is composed of only the laminated structure 61 and is also formed such that the size L1 in the front-rear direction thereof is longer than the width size L3. Thus, even when the operator of the conveying machine presses the fork against the end portion 67 to change the direction of the paper pallet 10 or move the paper pallet 10, the end portion 67 is prevented from being recessed or damaged, since the strength, in the front-rear direction, of the end portion 67 is sufficiently ensured.

Since the honeycomb structure 62 is configured so as to be lighter in weight than the laminated structure 61, each leg beam 51 is lighter in weight than a conventional leg beam that is composed of only the laminated structure 61, and thus is easily stored or handled.

The case where the cavity 61A is filled with the honeycomb structure 62 without any gap has been described in the above embodiment. However, for example, in the present disclosure, a plurality of short cavities may be defined at a predetermined interval in the longitudinal direction of each leg beam 51, and each cavity may be filled with the honeycomb structure 62.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A paper pallet comprising a plurality of long leg beams each formed such that a cross section thereof has a rectangular shape, wherein at least one of the plurality of leg beams includes:

an exterior sheet;

a laminated structure on which the exterior sheet is wound and in which a plurality of sheet-like paper core materials are laminated in a width direction of the at least one leg beam orthogonal to a longitudinal direction of the at least one leg beam; and a honeycomb structure fitted into a cavity formed within the laminated structure, the honeycomb structure having a plurality of tubular cells extending in the width direction.

2. The paper pallet according to claim 1, wherein the cavity is filled with the honeycomb structure.

3. The paper pallet according to claim 1, wherein a length between opposite ends of the at least one leg beam to the cavity in the longitudinal direction of the at least one leg beam is longer than a length of the at least one leg beam in the width direction of the at least one leg beam.

4. The paper pallet according to claim 1, wherein a weight per unit volume of the honeycomb structure is lighter than that of the laminated structure.

5. The paper pallet according to claim 1, wherein each of the plurality of paper core materials is a corrugated cardboard sheet, and each of the plurality of tubular cells is formed so as to have a regular hexagonal cross-sectional shape.

6. The paper pallet according to claim 1, wherein, in the at least one leg beam, the plurality of core materials of the laminated structure are laminated in a horizontal direction, and the plurality of tubular cells of the honeycomb structure extend in the horizontal direction.

7. A packaging case comprising:

a paper pallet comprising a plurality of long lea beams each formed such that a cross section thereof has a rectangular shape, wherein at least one of the plurality of leg beams includes: an exterior sheet; a laminated structure on which the exterior sheet is wound and in which a plurality of sheet-like paper core materials are laminated in a width direction of the at least one leg beam orthogonal to a longitudinal direction of the at least one leg beam; and a honeycomb structure fitted into a cavity formed within the laminated structure, the honeycomb structure having a plurality of tubular cells extending in the width direction;

a tray for supporting an article, the tray being joined to an upper surface of the paper pallet; and an outer case including a side plate forming an outer peripheral surface, the outer case being opened at a lower surface thereof, the side plate having a lower portion fitted to the tray, wherein the packaging case is configured to package the article in an internal space surrounded by the tray and the outer case.

* * * * *